US010962195B2

(12) United States Patent
Franz-Georg

(10) Patent No.: US 10,962,195 B2
(45) Date of Patent: Mar. 30, 2021

(54) METHOD FOR PRODUCING A DESIGN STRUCTURE FOR VEHICLES, AND LIGHTING DEVICE

(71) Applicant: HELLA GmbH & Co. KGaA, Lippstadt (DE)

(72) Inventor: Willeke Franz-Georg, Anroechte (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 389 days.

(21) Appl. No.: 15/977,312

(22) Filed: May 11, 2018

(65) Prior Publication Data

US 2018/0328565 A1 Nov. 15, 2018

Related U.S. Application Data

(63) Continuation of application No. PCT/EP2016/077294, filed on Nov. 10, 2016.

(30) Foreign Application Priority Data

Nov. 11, 2015 (DE) ..... 10 2015 119 445.7

(51) Int. Cl.
*F21S 43/50* (2018.01)
*F21S 41/55* (2018.01)
(Continued)

(52) U.S. Cl.
CPC ..... *F21S 43/51* (2018.01); *F21S 41/29* (2018.01); *F21S 41/50* (2018.01); *F21S 41/55* (2018.01);
(Continued)

(58) Field of Classification Search
CPC ..... F21S 41/26; F21S 41/265; F21S 41/285; F21S 41/29; F21S 41/50; F21S 41/55;
(Continued)

(56) References Cited

U.S. PATENT DOCUMENTS 124,016 A * 2/1872 Schneider ..... F21V 5/043 362/338
1,676,464 A * 7/1928 Arcy ..... F21V 5/00 362/309
(Continued)

FOREIGN PATENT DOCUMENTS

DE 10306889 A1 8/2004
DE 10359183 A1 7/2005
(Continued)

OTHER PUBLICATIONS

International Search Report dated Jan. 9, 2017 in corresponding application PCT/EP2016/077294.

*Primary Examiner* — Alan B Cariaso

(74) *Attorney, Agent, or Firm* — Muncy, Geissler, Olds & Lowe, P.C.

(57) ABSTRACT

A method for producing a styling arrangement for a lighting device of a vehicle, wherein a utilized light component of a light emitted by the light source is deflected by means of an optical unit to create a lighting function, and wherein a spill light component emitted by the light source is incident on the styling arrangement to illuminate the same, wherein a carrier part is provided, a multiplicity of design elements are integrally formed on its at least one flat side to produce a design component, in that the carrier part is bent about an axis extending transversely to long sides of the same, and in that the carrier part is attached by tabs integrally formed thereon to a support frame that holds a component of the lighting device.

12 Claims, 2 Drawing Sheets

(51) Int. Cl.

| | |
|---|---|
| ***F21S 43/27*** | (2018.01) |
| ***F21S 41/50*** | (2018.01) |
| ***F21V 5/04*** | (2006.01) |
| ***F21S 41/29*** | (2018.01) |
| ***F21S 43/20*** | (2018.01) |
| ***F21V 19/00*** | (2006.01) |
| ***F21V 5/00*** | (2018.01) |

(52) U.S. Cl.
CPC ..... *F21S 43/26* (2018.01); *F21S 43/27* (2018.01); *F21S 43/50* (2018.01); *F21V 5/043* (2013.01); *F21V 19/003* (2013.01); *F21V 5/008* (2013.01)

(58) Field of Classification Search
CPC .. F21S 43/26; F21S 43/27; F21S 43/50; F21S 43/51; F21V 5/008; F21V 5/043; F21V 19/003
See application file for complete search history.

(56) References Cited

U.S. PATENT DOCUMENTS 4,622,626 A * 11/1986 Sassmannshausen .. F21S 43/26 362/305
5,070,432 A * 12/1991 Kitazumi ..... F21S 43/50 362/538
6,050,705 A * 4/2000 Kusserow ..... F21S 41/255 362/299
7,407,310 B2 * 8/2008 Komatsu ..... F21S 41/333 362/509
7,997,779 B2 * 8/2011 Futami ..... F21S 41/43 362/539
8,596,842 B2 12/2013 Lee
9,423,089 B2 * 8/2016 Lee ..... F21S 41/47
2006/0002126 A1 1/2006 Koizumi et al.
2010/0302794 A1 * 12/2010 Oomen ..... F21V 7/0025 362/519
2011/0310610 A1 12/2011 Brown et al.
2013/0314946 A1 * 11/2013 Wilson ..... F21S 43/241 362/612
2015/0078021 A1 3/2015 Brown et al.
2015/0138821 A1 * 5/2015 Kosuge ..... F21S 43/14 362/511

FOREIGN PATENT DOCUMENTS

| | | | |
|---|---|---|---|
| DE | 102005050420 | A1 | 4/2007 |
| DE | 102011052650 | A1 | 5/2012 |
| DE | 102011052552 | A1 | 2/2013 |
| EP | 1710494 | A1 | 10/2006 |
| JP | 2006134700 | A | 5/2006 |
| JP | 20090199778 | A | 9/2009 |
| KR | 20100043510 | A | 4/2010 |

* cited by examiner

METHOD FOR PRODUCING A DESIGN STRUCTURE FOR VEHICLES, AND LIGHTING DEVICE

This nonprovisional application is a continuation of International Application No. PCT/EP2016/077294, which was filed on Nov. 10, 2016, and which claims priority to German Patent Application No. DE 10 2015 119 445.7, which was filed in Germany on Nov. 11, 2015, and which are both herein incorporated by reference.

BACKGROUND OF THE INVENTION

Field of the Invention

The present invention relates to a method for producing a styling arrangement for a lighting device of a vehicle, wherein a utilized light component of a light emitted by the light source is deflected via an optical unit to create a lighting function, and wherein a spill light component emitted by the light source is incident on the styling arrangement to illuminate the same.

In addition, the invention relates to a lighting device for vehicles having a light source for emitting light, having an optical unit for deflecting a utilized light component of the light corresponding to a predetermined lighting function in the primary direction of emission, and having a styling arrangement located at a lateral edge of the lighting device that can be illuminated by a spill light component of the light emitted by the light source to create style lighting.

Description of the Background Art

From DE 103 06 889 A1, a lighting device for vehicles having a light source and an optical unit is known, in which a styling arrangement is located at a lateral edge of the lighting device. The styling arrangement permits a predetermined visual appearance of a part of the lighting device in the non-operating state or in the operating state thereof. In this case, the styling arrangement is illuminated by a spill light component that is emitted by a light source of the lighting device and is not usable for the lighting function of the lighting device. The styling arrangement of the known lighting device has a flat design component that is provided with slots and is integrated into a top cover component of the lighting device. In addition, the styling arrangement has a styling screen that the slots of the design component overlap. The design component is part of the mask. The styling screen is mounted on the mask.

In the conventional art, however, it is a disadvantage that the styling arrangement is dependent on an outer contour of a lighting device due to its fastening to the mask of the lighting device. A change in the outer shape or contour of the lighting device always requires a change in the fastening of the styling arrangement.

SUMMARY OF THE INVENTION

It is therefore an object of the present invention is to provide a method for producing a styling arrangement for a lighting device, and also a lighting device, such that the styling arrangement can be integrated into the lighting device easily and in an adjustable manner by simple means.

In an exemplary embodiment, a carrier part is provided, a multiplicity of design elements are integrally formed on its at least one flat side to produce a design component, whereby the carrier part is bent about an axis extending transversely to long sides of the same, and whereby the carrier part is attached by tabs integrally formed thereon to a support frame that holds a component of the lighting device.

The styling arrangement can have a carrier part that is connected to a multiplicity of design elements. Bending the carrier part can give this styling arrangement a desired shape, which can be matched to the contour or to a cover component of the lighting device. By means of tabs integrally formed on the carrier part, the styling arrangement can be fastened in a simple way to a support frame of the lighting device that is present in any case. Advantageously, the assembly effort can be kept low by this means, wherein a great number of identical or different design elements can be attached to the carrier part. As a result, an adjustable and universal styling arrangement can be achieved through simple manufacturing means.

The multiplicity of design elements can be attached to the carrier part by molding in or molding on. This advantageously creates a one-piece component that has an especially high mechanical strength due to the carrier part that preferably is strip-shaped in design.

The carrier part can be produced from a metal carrier blank. For example, the carrier blank can be produced by stamping, which reduces manufacturing costs.

The carrier part can be bent around an axis in such a way that this axis is collinear or parallel to an optical axis of the lighting device when the styling arrangement is in an installation position. As a result, the styling arrangement can be arranged in a space-saving way inside a housing of the lighting device, which in particular is closed by a cover component. Advantageously, the styling arrangement can be positioned at a desired location within the housing.

A styling lens, which is made of a transparent or translucent material, is produced by injection molding and is associated with at least a part of the design component. The styling lens can be matte in design, for example, and have diffusion elements, in particular, so that the contour of the design elements is highlighted. Otherwise, the human eye would focus on the bright light source and not on the design elements. It is assumed that at least part of the styling lens is arranged at a radial distance from the design elements.

The styling lens can be attached to a lens holder of the lighting device, which holder has a receiving recess for this purpose. Advantageously, the styling lens can be integrated into the lighting device in a space-saving manner by this means.

The lighting device can also have a styling arrangement that has a curved design component that determines a structure of the style lighting, and has a styling lens coaxial to the design component, wherein diffusion elements for scattering the spill light component are associated with the styling lens, and whereby at least part of the styling lens is arranged at a radial distance from the design component.

The invention advantageously makes possible a space-saving integration of a styling arrangement in the interior of a lighting device. As a result of the fact that a design component and a styling lens associated therewith are curved in design, the styling arrangement can be positioned within the lighting device in a space-saving manner.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A styling arrangement 1 according to the invention can be integrated inside a lighting device implemented as a headlight or signal lamp. The lighting device may be arranged in a rear or front end region of a vehicle. In the present exemplary embodiment, the styling arrangement 1 is integrated into a headlight, which primarily has a support frame 2 and a lens holder 3 as load-bearing components.

Figure 1:
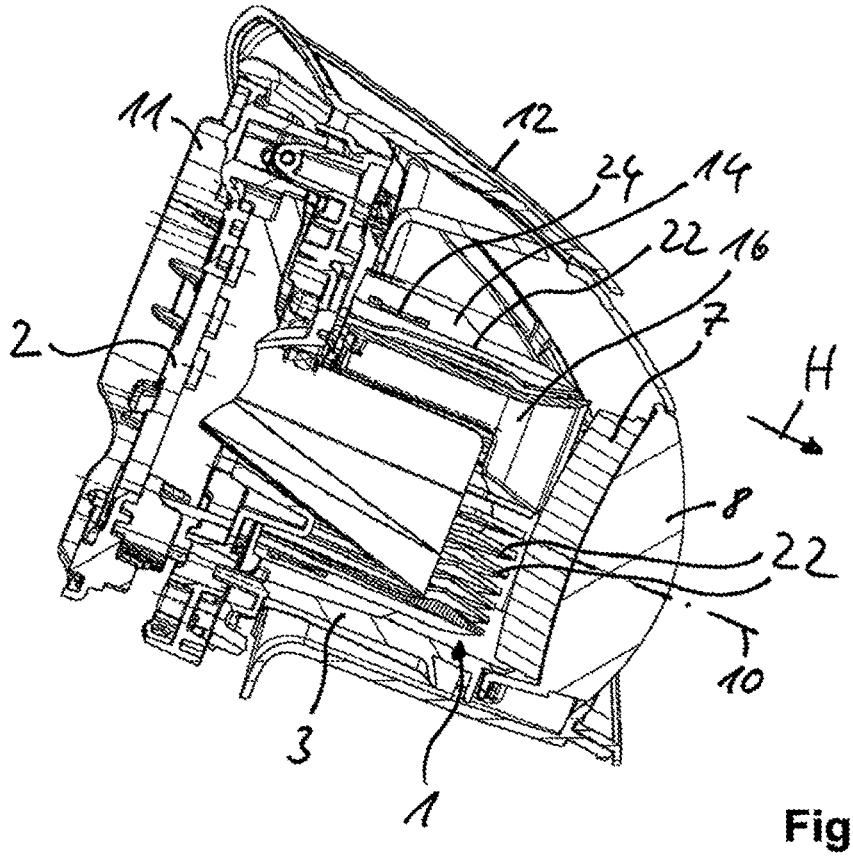
FIG. 1 is a vertical section through a lighting device viewed from the right.
Figure 2:
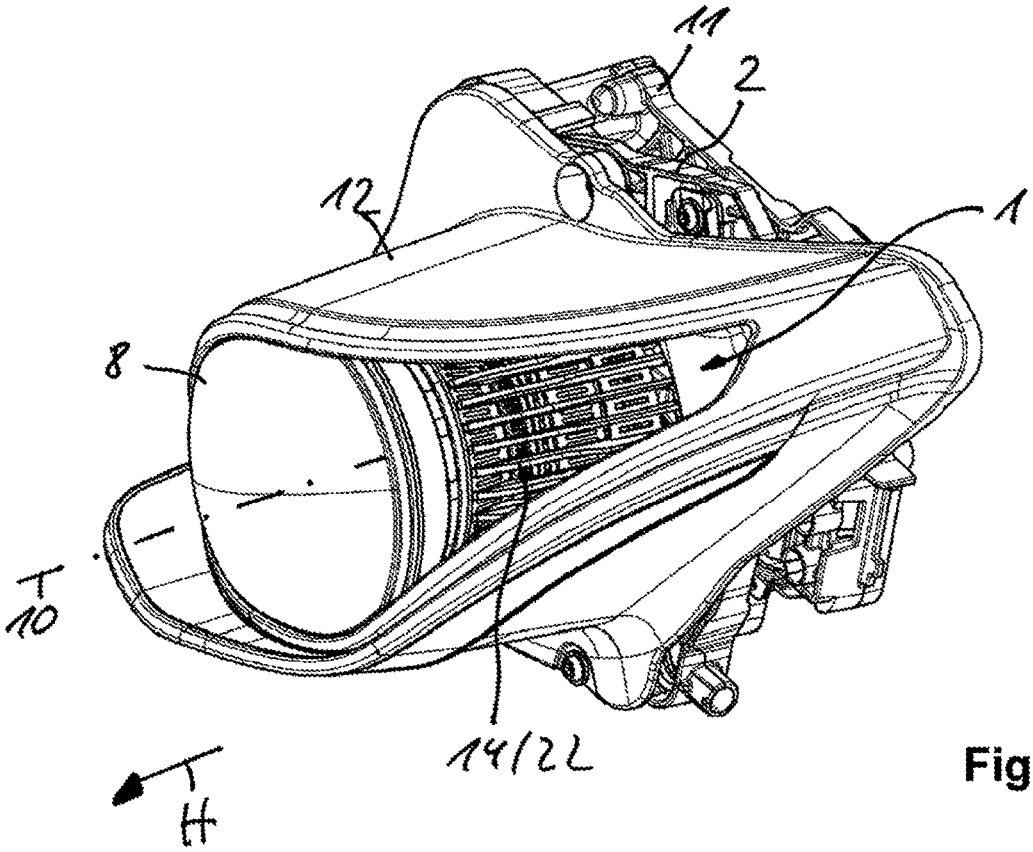
FIG. 2 is a perspective representation of the lighting device viewed from the left.
Figure 3:
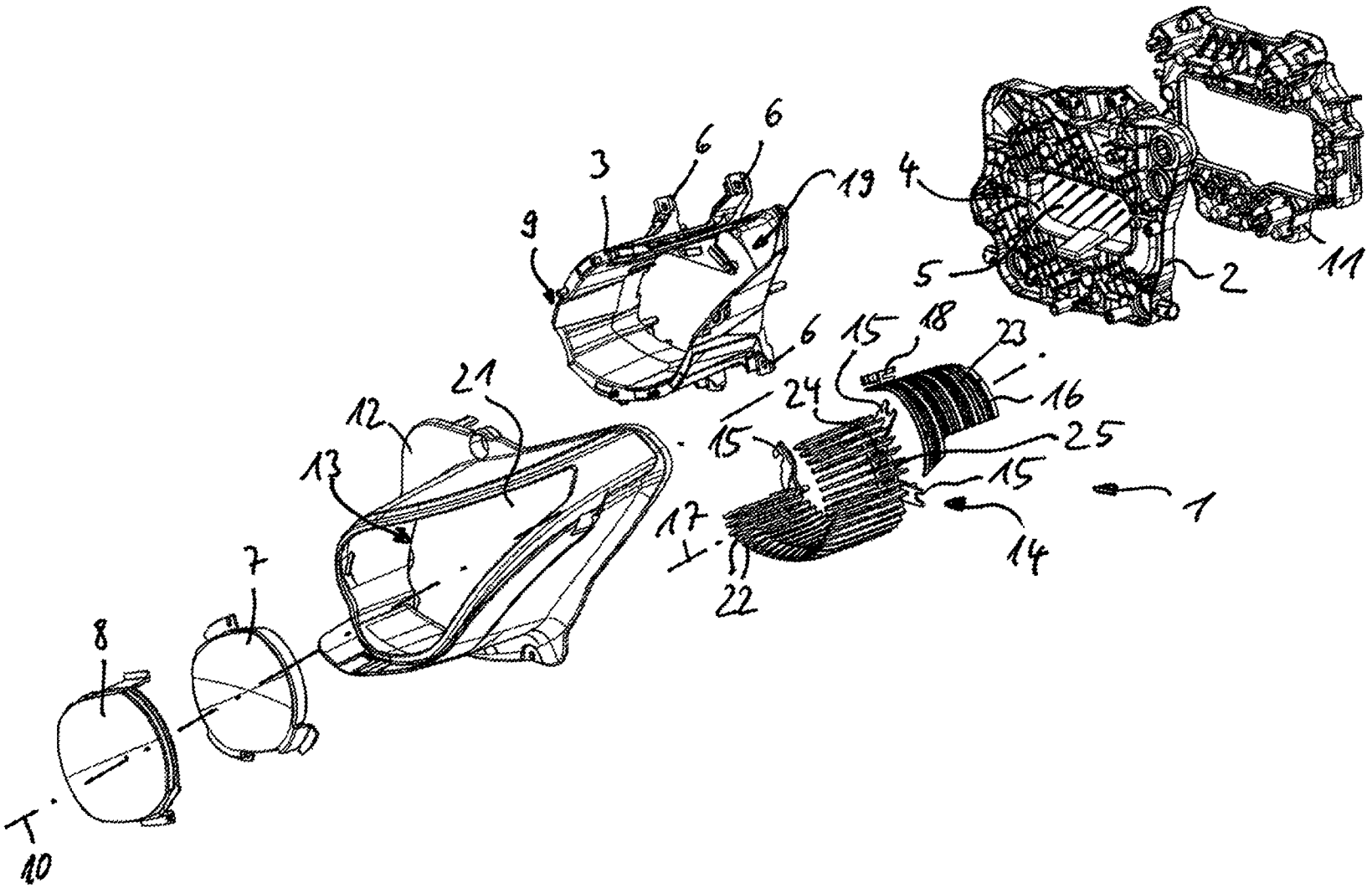
FIG. 3 an exploded view of components of the lighting device viewed from the left.

The support frame 2 has a central recess 4, in which is arranged a printed circuit board with a multiplicity of LED light sources. These light sources are distributed over the area in their arrangement, and achieve a luminous area 5, which is shown hatched in FIG. 3.

Located in front of the support frame 2 in the primary direction of emission H is the lens holder 3, which is attached to the support frame 2 by tabs 6. The lens holder 3 is designed such that a lens arrangement composed of a first lens 7 and a second lens 8 is held securely in position. The lenses 7, 8 are arranged one directly behind the other in the primary direction of emission H, namely in a front region 9 of the lens holder 3.

The first lens 7 and the second lens 8 are arranged to be coaxial to one another, forming an optical axis 10, which extends through the recess 4 of the support frame 2. The light sources arranged in the recess 4 of the support frame 2 emit light, wherein a utilized light component thereof emerges from the lighting device through the first lens 7 and the second lens 8 in the primary direction of emission H to generate a predetermined light distribution, for example a low beam light distribution.

Provided behind the support frame 2 in the primary direction of emission H is a housing plate 11, which, together with a cover component 12 attached thereto, forms the housing of the lighting device. The cover component 12 has a pear-shaped opening 13, which is closed by a clear cover lens.

The styling arrangement 1 is arranged inside this housing, and primarily has a curved design component 14 that is mounted on the support frame 2 by tabs 15 that are integrally formed on the design component 14. Preferably the styling arrangement 1 additionally has a styling lens 16, which is likewise curved in design and at least partially overlaps the design component 14. Both the design component 14 and the styling lens 16 are designed as partial cylinders about an axis 17 that coincides with the optical axis 10 in the installation position (collinear arrangement). Alternatively, the axis 17 can also be parallel to the optical axis 10. The styling lens 16 is held on the lens holder 3 by a fastener 18. The lens holder 3 has a receiving recess 19 for accommodating the styling lens 16, so that the styling lens 16 forms a part of the cylindrical wall of the lens holder 3 in a space-saving manner.

The styling lens 16 is arranged at a radial distance from the design component 14, wherein the design component 14 has a larger radius than the styling lens 16 in the present exemplary embodiment. The styling lens 16 and a part of the design component 14 are located in an upper, lateral edge of the housing, which is covered by a wedge 21 of the opening 13 of the cover component 12 or of the cover lens. The styling arrangement 1 is thus visible from the outside. A spill light component of the light emitted by the light source, which radiates to the side at a relatively steep angle in comparison to the utilized light component, illuminates the styling arrangement 1, wherein a predetermined style lighting is brought about by a structure or contouring of the styling arrangement 1.

In the present exemplary embodiment, the design component 14 has a multiplicity of rod-shaped design elements 22, which are arranged at a constant circumferential distance from one another and each of which extends essentially in the primary direction of emission H. The structure of the style lighting is determined by this means.

The styling lens 16 has a multiplicity of diffusion elements 23 by means of which the spill light component is scattered, and consequently an evening-out or homogenization of the ribbed structure of the design component 14 is achieved. The styling lens 16 is preferably transparent or translucent in design. It is manufactured from a transparent plastic material, for example, in particular by injection molding.

The design component 14 has an elongated, strip-shaped carrier part 24, which preferably is manufactured from a carrier blank made of sheet metal material. For example, the carrier blank 24 can be manufactured by stamping from sheet metal material. After the carrier blank 24 has been produced, it is placed in an injection mold so that subsequently the multiplicity of design elements 22 are joined to the carrier part 24 as a single piece by molding in or molding on to a flat side of the carrier part 24. Preferably, the carrier blank 24 is located inside the injection mold in a level operating position. The bending of the carrier part 24 about the axis 17 then takes place in a further step, so that the design component 14 assumes the curved or partial cylindrical shape. The axis 17, about which the carrier part 24 is bent, is perpendicular to long sides 25 of the carrier part 24. The carrier part 24, which extends in a curve in its installation position, is preferably elongated or strip-shaped in design. In the present exemplary embodiment, the design component 14 extends about an obtuse or reflex angle in the circumferential direction. The ribbed design elements 22 are made of a transparent or translucent and/or light-transmissive plastic material.

To assemble the lighting device, the styling lens 16 is attached by the fastener to the lens holder 3, and the design component 14 is attached by the tabs 15 to the support frame 2. Subsequently, the lens holder 3 is attached to the support frame 2. After that, the cover component 12 is connected to the housing plate 11 from the front while covering the lens holder 3 provided with the lenses 7, 8 and partially covering the styling arrangement 1 and the support frame 2. The cover component 12 is preferably made of an opaque plastic material.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for producing a styling arrangement for a light source of a lighting device of a vehicle, wherein a utilized light component of a light emitted by the light source is deflected via an optical unit to create a lighting function, and wherein a spill light component emitted by the light source is incident on the styling arrangement to illuminate the styling arrangement, the method comprising:

providing a carrier part by stamping sheet metal into a strip shape;

integrally forming and attaching at least two design elements on at least one flat side of the carrier part to produce a design component, the at least two design elements each being an individual elongated plastic rib;

bending an entirety of the carrier part with the at least two design elements attached thereto about an axis extending transversely to long sides of the carrier part, such that after bending, the carrier part is arcuate shaped; and attaching the carrier part, by tabs integrally formed thereon, to a support frame that holds a component lens holder of the lighting device.

2. The method according to claim 1, wherein the at least two design elements are attached to the carrier part by molding the at least two design elements to a side of the carrier part.

3. The method according to claim 1, wherein the at least two design elements are formed in an injection mold after the carrier part has been placed in a level operating position in the injection mold.

4. The method according to claim 1, wherein the carrier part is bent around the axis such that the axis is collinear or parallel to an optical axis of the lighting device when the styling arrangement is in an installation position.

5. The method according to claim 1, wherein a styling lens is produced by injection molding in a curved shape matched to a curved shape of the design component.

6. The method according to claim 5, wherein the styling lens is has an integrally formed fastener that is attached in a receiving recess of the lens holder, the lens holder carrying a lens of the lighting device.

7. The method according to claim 5, wherein the design component and the styling lens, while at least partially overlapping, are held on a lateral edge of the lighting device.

8. The method according to claim 1, wherein the carrier part, once bent, forms a partial cylinder.

9. The method according to claim 1, further comprising providing an arcuate shaped styling lens that is coaxial to the design component, wherein at least two diffusion elements for scattering the spill light component are associated with the styling lens.

10. A lighting device for a vehicle comprising:

a light source for emitting light;

an optical unit for deflecting a utilized light component of the light corresponding to a predetermined lighting function in a primary direction of emission; and a styling arrangement arranged at a lateral edge of the lighting device, the styling arrangement being illuminated by a spill light component of the light emitted by the light source to create style lighting, wherein the styling arrangement has an arcuate shaped design component that determines a structure of the style lighting, and has an arcuate shaped styling lens that is coaxial to the design component, wherein at least two diffusion elements for scattering the spill light component are associated with the styling lens, and wherein at least part of the styling lens is arranged at a radial distance from the design component.

11. The lighting device according to claim 10, wherein the design component and the styling lens are at least partially covered by a clear cover lens of the lighting device, and wherein the design component and the styling lens each form an individual partial cylinder.

12. The lighting device according to claim 10, wherein, with respect to a common axis to which both the design component and the styling lens are coaxial, the design component has a larger radius than the styling lens.

* * * * *